US012416166B2

(12) United States Patent
Boucké et al.

(10) Patent No.: US 12,416,166 B2
(45) **Date of Patent: *Sep. 16, 2025**

(54) PANEL INTERCONNECTABLE WITH SIMILAR PANELS FOR FORMING A COVERING

(71) Applicant: i4F Licensing NV, Turnhout (BE)

(72) Inventors: Eddy Alberic Boucké, Turnhout (BE); Johan Christiaan Rietveldt, Best (NL)

(73) Assignee: i4F Licensing NV, Turnhout (BE)

( * ) Notice: Subject to any disclaimer, the term of this patent is extended or adjusted under 35 U.S.C. 154(b) by 0 days.

This patent is subject to a terminal disclaimer.

(21) Appl. No.: 19/086,361

(22) Filed: Mar. 21, 2025

(65) Prior Publication Data

US 2025/0215704 A1 Jul. 3, 2025

Related U.S. Application Data

(63) Continuation of application No. 18/620,156, filed on Mar. 28, 2024, now abandoned, which is a continuation of application No. 17/730,922, filed on Apr. 27, 2022, now Pat. No. 11,946,261, which is a continuation of application No. 16/943,538, filed on Jul. 30, 2020, now Pat. No. 11,352,800, which is a continuation of application No. 16/296,325, filed on Mar. 8, 2019, now Pat. No. 10,774,540, which is a (Continued)

(30) Foreign Application Priority Data

Feb. 26, 2014 (WO) ..... PCT/NL2014/050118
Feb. 23, 2015 (BY) ..... a20150107

(51) Int. Cl.
*E04B 2/00* (2006.01)
*E04F 15/02* (2006.01)
*E04F 15/10* (2006.01)

(52) U.S. Cl.
CPC ..... *E04F 15/02038* (2013.01); *E04F 15/107* (2013.01); *E04F 2201/0138* (2013.01); *E04F 2201/0153* (2013.01); *E04F 2201/0161* (2013.01); *E04F 2201/023* (2013.01); *E04F 2201/043* (2013.01)

(58) Field of Classification Search
CPC ..... E04F 15/02038; E04F 15/107; E04F 2201/0153; E04F 2201/023; E04F 2201/043
See application file for complete search history.

(56) References Cited

U.S. PATENT DOCUMENTS 1,701,630 A 2/1929 Pullar
2,398,632 A 4/1946 Frost et al.
(Continued)

FOREIGN PATENT DOCUMENTS

CA 2363184 A1 7/2001
CN 2361725 Y 2/2000
(Continued)

*Primary Examiner* — Basil S Katcheves
(74) *Attorney, Agent, or Firm* — The Webb Law Firm

(57) ABSTRACT

The invention relates to a panel, in particular a floor panel, interconnectable with similar panels for forming a covering. The invention also relates to a covering consisting of mutually connected floor panels according to the invention. The invention further relates to a method of assembling multiple floor panels for forming a covering.

26 Claims, 7 Drawing Sheets

Related U.S. Application Data continuation of application No. 15/835,864, filed on Dec. 8, 2017, now Pat. No. 10,267,046, which is a continuation of application No. 15/121,460, filed as application No. PCT/NL2015/050120 on Feb. 26, 2015, now Pat. No. 9,874,028.

(56) References Cited

U.S. PATENT DOCUMENTS 2,834,065 A 5/1958 Mueller
2,852,815 A 9/1958 Sale
3,310,919 A 3/1967 Bue et al.
3,381,730 A 5/1968 Omholt
3,687,773 A 8/1972 Wangborg
3,921,312 A 11/1975 Fuller
4,426,820 A 1/1984 Terbrack et al.
4,696,132 A 9/1987 LeBlanc
5,113,632 A 5/1992 Hanson
5,182,892 A * 2/1993 Chase ..... E04F 15/04 52/553
5,274,979 A * 1/1994 Tsai ..... E04F 13/0878 52/610
5,894,700 A 4/1999 Sweet
6,006,486 A * 12/1999 Moriau ..... B27M 3/04 52/592.1
6,032,427 A 3/2000 Randjelovic
6,098,365 A 8/2000 Martin et al.
6,131,355 A * 10/2000 Groh ..... E04B 5/12 52/592.1
6,339,908 B1 1/2002 Chuang
6,490,836 B1 12/2002 Moriau et al.
6,505,452 B1 1/2003 Hannig et al.
6,591,568 B1 7/2003 Pålsson
6,729,091 B1 5/2004 Martensson
6,761,008 B2 7/2004 Chen et al.
6,766,622 B1 * 7/2004 Thiers ..... E04F 15/04 144/380
6,769,219 B2 8/2004 Schwitte et al.
6,823,638 B2 11/2004 Stanchfield
6,874,292 B2 4/2005 Moriau et al.
6,880,307 B2 4/2005 Schwitte et al.
6,928,779 B2 8/2005 Moriau et al.
6,955,020 B2 10/2005 Moriau et al.
7,121,058 B2 10/2006 Palsson et al.
7,398,625 B2 7/2008 Pervan
7,506,481 B2 3/2009 Grafenauer
D603,066 S 10/2009 Warren et al.
7,617,651 B2 11/2009 Grafenauer
7,654,054 B2 2/2010 Moriau et al.
7,712,280 B2 5/2010 Moriau et al.
7,757,453 B2 7/2010 Moriau et al.
7,810,297 B2 10/2010 Moriau et al.
7,874,119 B2 1/2011 Pervan et al.
7,958,689 B2 6/2011 Lei
7,980,043 B2 7/2011 Moebus
8,091,238 B2 1/2012 Hannig
8,215,076 B2 7/2012 Pervan et al.
D668,794 S 10/2012 Trudel
8,281,549 B2 10/2012 Du
8,365,499 B2 2/2013 Nilsson et al.
8,375,672 B2 2/2013 Hannig
8,689,512 B2 4/2014 Pervan
8,745,949 B1 6/2014 Pien
8,745,952 B2 6/2014 Perra et al.
8,756,899 B2 6/2014 Nilsson et al.
8,789,334 B2 7/2014 Moriau et al.
8,925,274 B2 1/2015 Darko et al.
8,950,148 B2 2/2015 De Boe
8,978,336 B2 3/2015 Perra et al.
9,156,233 B2 10/2015 Dossche et al.
9,217,250 B2 12/2015 Perra et al.
9,260,870 B2 2/2016 Vermeulen et al.
D755,411 S 5/2016 Hill et al.
9,874,028 B2 * 1/2018 Boucké ..... E04F 15/02038
10,344,485 B2 7/2019 Muehlebach
10,774,540 B2 * 9/2020 Boucké ..... E04F 15/02038
11,313,135 B1 4/2022 Kenny et al.
11,668,099 B2 6/2023 Cappelle
2001/0010139 A1 8/2001 De Kerpel et al.
2001/0034991 A1 11/2001 Martensson et al.
2002/0007608 A1 1/2002 Pervan
2003/0066588 A1 4/2003 Palsson et al.
2003/0093964 A1 * 5/2003 Bushey ..... E04F 15/02 52/459
2003/0224147 A1 12/2003 Maine et al.
2004/0107665 A1 6/2004 Faxe et al.
2004/0177584 A1 9/2004 Pervan
2004/0200175 A1 10/2004 Weber
2005/0028474 A1 * 2/2005 Kim ..... E04F 15/04 52/578
2005/0171246 A1 8/2005 Maine et al.
2005/0183370 A1 8/2005 Cripps
2006/0064940 A1 3/2006 Cappelle
2006/0156666 A1 * 7/2006 Caufield ..... E04F 15/10 52/483.1
2006/0260253 A1 11/2006 Brice
2007/0130872 A1 6/2007 Goodwin et al.
2007/0245663 A1 10/2007 Hahn et al.
2008/0034701 A1 * 2/2008 Pervan ..... B44C 5/0469 52/309.3
2008/0241440 A1 10/2008 Bauer
2009/0019808 A1 1/2009 Palsson et al.
2009/0049787 A1 2/2009 Hannig
2009/0126308 A1 * 5/2009 Hannig ..... B27F 1/04 52/588.1
2009/0193741 A1 8/2009 Cappelle
2009/0249731 A1 10/2009 Cappelle
2010/0031594 A1 2/2010 Liu et al.
2011/0056167 A1 3/2011 Nilsson
2011/0131909 A1 6/2011 Hannig
2011/0138722 A1 6/2011 Hannig
2012/0266555 A1 10/2012 Cappelle
2012/0317911 A1 12/2012 Huang
2013/0104486 A1 5/2013 Windmóller
2013/0139463 A1 6/2013 DeLong
2013/0219806 A1 8/2013 Carrubba
2013/0263547 A1 10/2013 Boo
2013/0309441 A1 11/2013 Hannig
2014/0109507 A1 4/2014 Dossche et al.
2014/0150369 A1 6/2014 Hannig
2014/0165493 A1 6/2014 Palsson et al.
2014/0242342 A1 8/2014 Vandevoorde et al.
2014/0283477 A1 9/2014 Hannig
2015/0050443 A1 2/2015 Roy et al.
2015/0121793 A1 5/2015 Segaert et al.
2015/0240500 A1 8/2015 Stevens, Jr.
2015/0337540 A1 11/2015 Cappelle
2015/0337542 A1 11/2015 Cappelle et al.
2015/0368912 A1 12/2015 Baert et al.
2016/0186443 A1 6/2016 Perra et al.
2017/0037640 A1 2/2017 Boucke et al.
2017/0284105 A1 10/2017 Ceysson et al.
2018/0030667 A1 2/2018 Penland, Jr. et al.
2018/0142478 A1 5/2018 Xu
2019/0017278 A1 1/2019 De Rick et al.
2019/0383031 A1 12/2019 Baert et al.
2020/0353722 A1 11/2020 Naeyaert et al.
2021/0079666 A1 3/2021 Caselli et al.
2021/0087830 A1 3/2021 Ylikangas et al.
2021/0087832 A1 3/2021 Boo
2021/0114344 A1 4/2021 Van Vlassenrode
2021/0355688 A1 11/2021 Boo
2022/0090391 A1 3/2022 Nilsson
2024/0392582 A1 11/2024 Boucke et al.

FOREIGN PATENT DOCUMENTS

DE 19933343 A1 2/2001
DE 102005028072 A1 12/2006
DE 102005043721 A1 4/2007
DE 102006011887 A1 7/2007
DE 202008011589 U1 1/2009
DE 102011086846 A1 8/2012

(56) References Cited

FOREIGN PATENT DOCUMENTS

| | | | |
|---|---|---|---|
| EP | 0214643 | A2 | 3/1987 |
| EP | 1243721 | A2 | 9/2002 |
| EP | 1518032 | A1 | 3/2005 |
| EP | 1585875 | B1 | 10/2005 |
| FR | 2416988 | A1 | 9/1979 |
| FR | 2746127 | A1 | 9/1997 |
| FR | 2826391 | A1 | 12/2002 |
| GB | 816243 | | 7/1959 |
| GB | 2216976 | A | 10/1989 |
| JP | H170939 | U | 5/1989 |
| JP | H324538 | U | 3/1991 |
| JP | H6117081 | A | 4/1994 |
| JP | H7300979 | A | 11/1995 |
| JP | H8270193 | A | 10/1996 |
| JP | H1144084 | A | 2/1999 |
| JP | 20024552 | A | 1/2002 |
| KR | 100947849 | B1 | 3/2010 |
| KR | 1020130027961 | A | 3/2013 |
| WO | 0063510 | A1 | 10/2000 |
| WO | 0175247 | A1 | 10/2001 |
| WO | 0188306 | A1 | 11/2001 |
| WO | 03016654 | A1 | 2/2003 |
| WO | 2004003314 | A1 | 1/2004 |
| WO | 2006133690 | A1 | 12/2006 |
| WO | 2007118352 | A1 | 10/2007 |
| WO | 2012084604 | A1 | 6/2012 |

* cited by examiner

PANEL INTERCONNECTABLE WITH SIMILAR PANELS FOR FORMING A COVERING

CROSS REFERENCE TO RELATED APPLICATIONS

This application is a continuation application of U.S. patent application Ser. No. 18/620,156, filed Mar. 28, 2024, which is a continuation of U.S. patent application Ser. No. 17/730,922, now U.S. Pat. No. 11,946,261, filed Apr. 27, 2022, which is a continuation of U.S. patent application Ser. No. 16/943,538, now U.S. Pat. No. 11,352,800, filed Jul. 30, 2020, which is a continuation of U.S. patent application Ser. No. 16/296,325, now U.S. Pat. No. 10,774,540, filed Mar. 8, 2019, which is a continuation of U.S. patent application Ser. No. 15/835,864, now U.S. Pat. No. 10,267,046, filed Dec. 8, 2017, which is a continuation application of U.S. patent application Ser. No. 15/121,460, now U.S. Pat. No. 9,874,028, filed on Feb. 26, 2015, which is the United States national phase of International Application No. PCT/NL2015/050120, filed Feb. 26, 2015, and claims priority to International Application No. PCT/NL2014/050118, filed Feb. 26, 2014, and Belarusian Patent Application No. a20150107, filed Feb. 23, 2015, respectively, the disclosures of all of which are hereby incorporated in their entirety by reference.

BACKGROUND OF THE INVENTION

Field of the Invention

The invention relates to a panel, in particular a floor panel, more in particular laminated floor panel, interconnectable with similar panels for forming a covering. The invention also relates to a covering consisting of mutually connected floor panels according to the invention. The invention further relates to a method of assembling multiple floor panels for forming a covering.

Description of Related Art

The last ten years has seen enormous advance in the market for laminate for hard floor covering. It is known to install floor panels on a underlying floor in various ways. It is, for example, known that the floor panels are attached at the underlying floor, either by gluing or by nailing them on. This technique has a disadvantage that is rather complicated and that subsequent changes can only be made by breaking out the floor panels. According to an alternative installation method, the floor panels are installed loosely onto the subflooring, whereby the floor panels mutually match into each other by means of a tongue and groove coupling, whereby mostly they are glued together in the tongue and groove, too. The floor obtained in this manner, also called a floating parquet flooring, has as an advantage that it is easy to install and that the complete floor surface can move which often is convenient in order to receive possible expansion and shrinkage phenomena. A disadvantage with a floor covering of the above-mentioned type, above all, if the floor panels are installed loosely onto the subflooring, consists in that during the expansion of the floor and its subsequent shrinkage, the floor panels themselves can drift apart, as a result of which undesired gaps can be formed, for example, if the glue connection breaks. In order to remedy this disadvantage, techniques have already been through of whereby connection elements made of metal are provided between the single floor panels in order to keep them together. Such connection elements, however, are rather expensive to make and, furthermore, their provision or the installation thereof is a time-consuming occupation. There is a need to improve the coupling profiles of panels, in particular floor panels, which lead to a relatively reliable and durable connection at all edges, and which can be installed relatively easily, preferably without needing additional connection means, such as glue or metal connection elements.

Floor panels and their coupling is for instance known from WO03/016654, which discloses a fastening system for floor panels. The system comprises retaining profiles disposed on the small faces of the panels, wherein opposite retaining profiles match said retaining profiles in such a manner that similar panels can be interlinked. The panels are provided with opposite first retaining profiles that are configured in such a manner that on a panel being in first line a new panel can be locked in second line by attaching the new panel to the installed panel at a temporary angle relative to the installed panel and then swiveling it down into the plane of the installed panel. The panel further comprises opposite second retaining elements that comprise corresponding hook elements. A hook connection can be established by means of one of the hook elements of the new panel and a hook element of a panel that is already installed in second line by swiveling down the new panel. Every hook connection is associated with an additional locking element that prevents, in the hooked state of two panels, the hook connection from being released in a direction perpendicular to the plane of the installed panels.

US2011/056167 discloses a method of assembling resilient floorboards including the step of bending an edge of a floorboard during the assembling. The bending reduces the force required for connection of the edge to another edge of a juxtaposed floorboard.

SUMMARY OF THE INVENTION

It is an object of the invention to provide an improved floor panel, which can be coupled in an improved manner to other panels, and whereby preferably one or more of the aforementioned disadvantages are excluded.

It is a further object of the invention to provide an improved panel, in particular floor panel, which can be connected to similar panels in a relatively easy manner while leading to a relatively reliable and firm connection between panels.

The invention provides for this purpose a panel, in particular a floor panel, more in particular a laminated floor panel, interconnectable with similar panels for forming a covering, comprising: a centrally located core provided with an upper side and a lower side, said core being provided with: a first pair of opposite edges, comprising: a first edge comprising a sideward tongue extending in a direction substantially parallel to the upper side of the panel, the bottom front region of said sideward tongue being rounded at least partly and preferably substantially completely, the bottom back region of said tongue being configured as bearing region, wherein the bottom back region is located closer to the level of the upper side of the panel than a lowest part of the bottom front region, an opposite, second edge comprising a recess for accommodating at least a part of the sideward tongue of a further panel, said recess being defined by an upper lip and a lower lip, said lower lip being provided with a upwardly protruding shoulder for supporting and/or facing the bearing region of the sideward tongue, the sideward tongue being designed such that locking takes place by an introduction movement into the recess of the sideward tongue a further panel and a angling down movement about an axis parallel to the first edge, as a result of which a top side of the sideward tongue will engage the upper lip and the bearing region of the sideward tongue will be supported by and/or facing the shoulder of the lower lip, leading to locking of adjacent panels at the first and second edges in both horizontal direction and vertical direction; and a second pair of opposite edges, comprising: a third edge comprising a single upward tongue, at least one upward flank lying at a distance from the upward tongue and a single upward groove formed between the upward tongue and the upward flank, wherein at least a part of a side of the upward tongue facing toward the upward flank is inclined toward the upward flank and extends in the direction of the normal of the upper side of the core, and a fourth edge comprising a single downward tongue, at least one downward flank lying at a distance from the downward tongue, and a single downward groove formed between the downward tongue and the downward flank, wherein at least a part of a side of the downward tongue facing toward the downward flank is inclined toward the downward flank and extends in the direction of the normal of the lower side of the core, wherein a side of the downward tongue facing away from the downward flank is provided with a locking element, preferably formed by a bulge, and wherein the upward flank is provided with a counter-locking element, preferably formed by a cavity, said locking element being adapted to cooperate with said counter-locking element of another panel, the third and fourth edges being designed such that locking takes place during angling down of a panel to be coupled at a first edge to a second edge of a further panel, wherein the fourth edge of a panel to be coupled makes a scissoring movement toward a third edge of yet another panel, such that the downward tongue of the fourth edge of the panel to be coupled will be forced into the upward groove of the third edge of said other panel and the upward tongue of said other panel will be forced into the downward groove of the panel the be coupled, by deformation of the third edge and/or the fourth edge, leading to locking of adjacent panels at the third and fourth edges in both horizontal direction, vertical direction, and leading to the locking element to co-act with the counter-locking element to realise an additional locking in vertical direction as well as a locking rotational direction.

The panel according to the invention comprises at a first pair of opposing edges a first set of complementary coupling profiles and at a second pair of opposing edges a distinctive second set of complementary coupling profiles. The first and second edges facilitate an easy installation of a panel by inserting the sideward tongue of the first edge of the panel to be coupled in an inclined position into the recess of the second edge of an already installed panel, after which that panel will be angled (pivoted) downwardly until both panels are situated in the same plane. Although this angling down process leads to locking of both panels at the first and second edges both in horizontal direction and in vertical direction, a substantially improved locking will be realized due to the presence of the third and fourth edges, and more in particular by forcing the fourth edge of the panel to be coupled to snap into the third edge of another panel during the angling down movement of the panel to be coupled, wherein the downward tongue is snapped into the closed upward groove, and wherein the locking element is brought into contact with the counter-locking element to provide an additional locking. Coupling of the third edge and the complementary fourth edge of adjacent panels leads to a triple lock at between said panels, in particular (i) a locking in horizontal direction, (ii) a locking in vertical direction, and (iii) a locking in rotational direction. The locking in horizontal direction is caused by the substantially vertical orientation of the tongues of the third and the fourth edges, which act as hook-shaped elements preventing drifting apart (in horizontal direction) of third edge and the fourth edge in a coupled state. The vertical locking is firstly caused by the application of said closed upward groove (due to aforementioned inclined side surface (inner surface) of the upward tongue) and said closed downward groove (due to the aforementioned inclined side surface (inner surface) of the downward tongue, which leads to a snapping action during coupling and an enclosing of at least a part of the downward tongue by the upward groove as well as an enclosing of at least a part of the upward tongue by the downward groove after coupling, resulting in a locking in vertical direction. Hence, since the third profile is provided with a closed upward groove, whereas at least a part of a side of the upward tongue facing toward the upward flank extends in the direction of the normal of the upper side of the core, and since the fourth profile is provided with a closed downward groove, whereas at least a part of a side of the downward tongue facing toward the downward flank extends in the direction of the normal of the lower side of the core, an interconnection of the third and fourth edges of adjacent panels can only be established after a (temporary), preferably resilient, deformation of the third edge and/or the fourth edge leading. This vertical locking is secondly caused and assisted by the co-action between the locking element and the counter-locking element in the coupled state of the third edge and the fourth edge. Due to both vertical locking effects the realised vertical locking as such is relatively firm. Commonly the second vertical locking effect—caused by the co-action between the locking element and the counter-locking element—is required to realise a vertical locking between adjacent panels as such, though this depends on the degree of inclination of the (inner) side surfaces of the upward tongue and the downward tongue respectively. Since this inclination is commonly and preferably restricted to an extent of between 1 and 10 degrees, more preferably between 1 and 5 degrees, with respect to a vertical plane, which secures easy coupling of the third edge and the fourth edge, this inclination as such renders uncoupling of coupled panels somewhat more difficult though will commonly not lead to an aimed (stable) vertical locking between the panels as such, wherein the aimed (stable) vertical locking is merely realised by additionally allowing the locking element and counter-locking element to co-act. The rotational locking prevents, or at least hinders, pivoting between panels connected at a third edge and fourth edge respectively. Due to this triple locking mechanism a relatively firm, reliable, and durable connection can be realised between the third edge and the fourth edge of adjacent panels, which allows, moreover, easy coupling of the third edge and the fourth edge. The connection between the third edge and the fourth edge is therefore preferably free of play. Since the third and fourth edges are commonly perpendicular to the first and second edge, a scissoring movement will occur during angling down of a panel to be coupled, leading to snapping or zipping of the fourth edge of a panel to coupled and the third edge of an already installed panel into each other. Hence, the panel according to invention can be assembled in a relatively easy manner, without the need of additional connection elements, while leading to a firm and durable connection.

At the first and second edges, a locking in horizontal direction between two panels is established by the presence of upwardly protruding shoulder, which prevents the bottom front region of the sideward tongue (male part) to be displaced in a horizontal direction with respect to the complementary recess (female part) and the upwardly protruding shoulder. Hence, the shoulder locks the bottom front region of the sideward tongue in place. Preferably, the shoulder has a substantially flat upper surface. An upper surface of the shoulder is preferably oriented substantially horizontally. A shoulder wall facing or directed towards the panel core is preferably sufficiently inclined (steep) to act as locking surface for locking connected panels in horizontal direction. Preferably, at least an upper end part of said (inner) shoulder wall, connecting to an upper shoulder surface, extends in a direction of at least 45 degrees, more preferably at least 60 degrees with respect to a horizontal plane, which will secure a firm locking in horizontal direction. Said shoulder wall can be flat though is preferably curved, since a curved shoulder wall facilitates insertion of a sideward tongue of a first panel into the recess of the second edge of a second panel. Preferably, a bottom region of the lower lip extending between the core and the shoulder is at least partially curved (rounded), wherein more preferably the shape of said bottom region of the lower lip is substantially complementary to the shape of the at least partially rounded bottom front region of the sideward tongue. The complementary rounded surfaces will act as sliding surfaces during coupling of the panels. The upper surface has a substantially complementary shape with respect to a corresponding bottom region of the lower lip. A locking in vertical direction at the first and second edges of two panels is established by the engagement of a top surface of the sideward tongue to a bottom surface of the upper lip acting as locking surface. In fact, the upper lip prevents the inserted sideward tongue to be displaced in vertical direction. After coupling, a top surface of the sideward tongue preferably at least partially engages a bottom surface of the upper lip. After coupling, a top surface of the sideward preferably engages the complete bottom surface of the upper lip. This partial or complete engagement prevents play between coupled panels. Hence, panels can be coupled free of play at the first edge and the second edge.

At the third and fourth edges, a locking in horizontal direction between two panels is established by the presence of the upward tongue at the third edge which engages to the downward tongue at the fourth edge (of another panel), which prevents the two panels to be drifted apart. At the third and fourth edges, a locking in vertical direction between two panels is established by the application of the closed grooves as indicated above, and moreover, due to the presence of the additional first and second locking elements. Moreover, due to the particular shape of the third and fourth edges, a locking in rotational directional will commonly also be established. The third and fourth edges can be mutually connected either by a scissoring action (zipping action) during angling down of a panel to be coupled, although it is also conceivable to connect the third and fourth edges by vertical displacement, wherein the downward tongue (as a whole) is downwardly pushed into the upward groove. Regardless of the installation method, either the third edge and/or fourth edge will slightly deform during coupling to allow the tongues to be inserted into the complementary closed grooves. After establishment of the coupling, both the third edge and the fourth edge preferably have their original shape again and will no longer be deformed. Preferably, the third edge and the fourth edge have substantially complementary shapes, such that none of the third edge and the fourth edge will exert (compression) forces onto each other once coupled. The absence of any (pre) tension in the coupled state of the third and fourth edge will reduce the material stress to practically zero in the coupled state, which will be in favour of the durability of the third edge as such, the fourth edge as such, and consequently to the connection between these edges in the coupled state. Preferably, (also) the third edge and the fourth edge can be connected free of play.

The (floor) panel according to the invention is primarily intended for so-called laminated floors, but generally it can also be applied for other kinds of covering, consisting of hard floor panels, such as veneer parquet, prefabricated parquet, or other floor panels which can be compared to laminated flooring. Hence, the floor panel according to the invention is preferably a laminated floor panel. A laminated floor panel is considered as a floor panel comprising multiple material layers. A typical laminated floor panel comprises at least one central core layer, and at least one further layer attached to either at a bottom surface and/or top surface of said core layer. A backing layer attached to at least a part of a bottom surface is also referred to as a balancing layer. This backing layer commonly covers the core of the panel, and optionally, though not necessarily, one or more edges of the panel. On top of the core, commonly one or more additional layers are applied, including at least one design layer (decorative layer) which is preferably covered by a substantially transparent protective layer. The decorative layer may be formed by a paper layer onto which a decorative pattern is printed, though it is also thinkable that the decorative design is directly printed onto the core or onto a core coating. The protective layer may have a profiled top surface, which may include an embossing which corresponds to the decorative pattern (design) visualised underneath the protective layer, to provide the floor panel an improved feel and touch. Different materials may be used for the layers. The core, for example, can be formed of a MDF or HDF product, provided with a protective layer. The core could also be formed of a synthetic material, such as a thermoplastic like polyvinyl chloride (PVC), and/or a thermoplastic material which is enriched with one or more additives. The thermoplastic material may be fibre reinforced and/or dust reinforced. To this end, a dust-(thermo) plastic-composite may be used as core material. The expression "dust" is understood is small dust-like particles (powder), like wood dust, cork dust, or non-wood dust, like stone powder, in particular cement. By combining bamboo dust, wood dust, or cork dust, or combination thereof, with for example high density polyethylene (HDPE), or polyvinylchloride (virgin, recycled, or a mixture thereof), a rigid and inert core is provided that does not absorb moisture and does not expand or contract, resulting in peaks and gaps. An alternative material which may be used to manufacture at least a part of the floor panel according to the invention, in particular the core layer, is ceramics or cement. Instead of a laminated floor panel, the floor panel according to the invention may also be formed by a single layer floor panel, which may for example be made of wood. Preferably, the edges are integrally connected to the core.

The panel according to the invention can also be applied to form an alternative covering, for example a wall covering or a ceiling covering.

The recess is preferably terminated by the shoulder. By using this definition, the recess will be configured to accommodate that front region of the tongue, while the back region acting as bearing region will be positioned outside the recess. The recess will therefore in vertical direction be limited and defined by the upper lip and the lower lip, and will in horizontal direction be limited and defined by the core and the shoulder. As indicated above, a bottom surface of the front region of the sideward tongue is at least partly rounded, which facilitates angling down of the panel, wherein a more or less central part of the front region of the sideward tongue will act as pivoting axis. Since the sideward tongue is inserted into the recess during angling down, the pivoting axis will be displaced slightly during the angling down process. Commonly, the shape of a bottom surface of the lower lip defining the recess, configured for supporting the front region of the sideward tongue, is preferably complementary to the shape of the bottom front region of the sideward tongue. In this manner, the number of gaps between the sideward tongue and the bottom surface of the lower lip defining the recess can be kept to a minimum, which will commonly be in favour of the prevention of play between the edges, and hence to the solidness of the connection. Therefore, the bottom surface of the recess is preferably also at least partly rounded. The roundness of the matching surface can be either smooth or (somewhat) hooked, for example by hooked surface segments, to form a rounded shape. Alternatively, the bottom surface of the lower lip defining the recess can also be given another shape, for example a substantially flat shape, which could be in favour of minimizing the resistance between two panels during the angling down process, which could facilitate the installation process.

The upper lip and the lower lip are connected to the core, and preferably extend in a direction which is substantially parallel to the upper side of the core. Preferably, the lower lip is substantially longer than the upper lip, more preferably at least four times longer. In between the upper lip and the lower lip a cavity is created, which cavity makes part of the recess. This cavity will commonly act as locking part of the recess, wherein a top surface of said locking part acts as locking surface and is configured to co-act with a top surface of the front region of the sideward tongue of a further panel. This locking surface preferably has an inclined orientation, and wherein at least a front region of the top surface of the sideward tongue has a corresponding inclined orientation. An inclined orientation of the locking surface commonly facilitates coupling of panels at the first and second edge.

It is commonly advantageous in case a side of the shoulder facing the core has an inclined orientation for forcing two panels, in an assembled state, toward each other. Preferably a complementary surface of the bearing region of the sideward tongue has a substantially identical inclined orientation. This inclination preferably runs downward from the shoulder in the direction of the core. By applying such an inclined orientation a driving surface will be created for driving (forcing) an inserted sideward tongue in the direction of the core of the panel, which will be in favour of the firmness of the coupling at the first and second edges.

In a preferred embodiment, the width of the bearing region of the sideward tongue is greater than the width of the shoulder. The width is perpendicular to the length of the sideward tongue and the shoulder, and hence perpendicular to the longitudinal axis of the first and second edge. By applying a bearing region having a greater width than the width of the shoulder, a gap will be created between the shoulder and the core of an adjacent panel. This gap will commonly facilitate the angling down process, since more space during the angling down process.

The panel according to the invention can either have a square shape or a rectangular shape. The first pair of opposite edges have a substantially parallel orientation. The same applies to the second pair of opposites edges which also have a mutually substantially parallel orientation. The angle enclosed by the first pair of edges and the second pair of edges is substantially perpendicular. In a preferred embodiment the panel has a substantially rectangular shape, wherein the first pair of opposite edges are located on the long sides of the panel, and the second pair of opposite edges are located on the short sides of the panel. This orientation allows the long edges of a first panel and a second panel to be engaged first, after which the short edges of the first panel and a third panel will be connected during lowering (angling down) of the first panel. It is imaginable to modify this embodiment by applying the first and second edges to the short edges, and the third and fourth edges to the long edges. In this latter embodiment, first the short edges of different panels will be brought in contact which each other, after which during angling down of one of the panels the long sides of the panel will be connected to another panel.

In a preferred embodiment at least a part of a side of the upward tongue facing toward the upward flank forms an (inclined) upward aligning edge for the purpose of coupling the third edge to a fourth edge of an adjacent panel. This upward aligning edge can be flat and/or rounded. The upward aligning edge facilitates a correct positioning (alignment) of the fourth edge of a panel with respect to a third edge of an adjacent panel which will commonly facilitate mutual coupling of the third edge and the fourth edge. The upward aligning edge can be considered as being a part of the (inner) side wall of the upward tongue. The upward aligning edge is preferably (substantially) smaller than an inclined remaining portion of the (inner) side wall of the upward tongue. More preferably, the upward aligning edge and the remaining portion of the upper surface of the upward tongue mutually enclose an angle, preferably an angle between 75 and 165 degrees. The upward aligning edge adjoins an upper surface of the upward tongue. Preferably, this upper surface substantially completely faces away from the upward flank. Preferably, this (complete) upper surface has an inclined orientation, wherein more preferably this upper surface runs downwardly in a direction away from the upward flank. Hence, this inclined upper surface may also act as (outer) upward aligning edge adjacent to the (inner) upward aligning edge as specified above, which further facilitates coupling of panels at the third edge and the fourth edge. The wording "aligning edge" can be replaced by the wording "guiding edge" or "guiding surface". Preferably, at least a part of a side of the upward tongue facing away from the upward flank comprises a substantially rigid first locking element, and wherein the downward flank comprises a substantially rigid, second locking element adapted for co-action with a first rigid locking element of a third edge of a third panel. The upper surface of the upward tongue adjoins at an outer side surface of the upward tongue, said outer side surface being provided with the first locking element. Said outer side surface preferably has a substantially vertical orientation. Thus, preferably the first locking element is located on a substantially vertical part of the upward tongue, such that above and below the locking element the upward tongue has a substantially vertically orientated surface. The inclination of the upper surface of the upward tongue is preferably situated between 15 and 45 degrees, more preferably between 25 and 35 degrees, and is most preferably about 30 degrees, with respect to a horizontal plane. The inclination of the upper surface of the upward tongue is preferably constant, which means the upper surface has a flat orientation. Preferably, an upper side of the downward groove has a, preferably likewise (compared to the inclination of the upper surface of the upward tongue (if applied)), inclining orientation, which is more preferably upward in the direction of the side of the downward tongue facing towards to downward flank. A lower surface of a bridge connecting the downward tongue to the core is formed by the upper surface of the downward groove. Applying an inclined upper surface of the downward groove will result in a varying thickness of the bridge, as soon from the core to the outer end of the third edge. As aforementioned, the upper surface of the downward groove preferably runs inclining upward in the direction of the side of the downward tongue facing towards to downward flank, which results in the fact that the bridge thickness decreases in the direction of the downward tongue. This position-dependent bridge thickness, wherein the bridge thickness is relatively large close to the core and relatively small close to the downward tongue, bridge thickness has multiple advantages. The thicker part of the bridge, close to the core, provides the bridge more and sufficient strength and robustness, while the thinner part of the bridge, close to the downward tongue, forms the weakest point of the bridge and will therefore be decisive for the location of first deformation (pivoting point) during coupling. Since this point of deformation is located close to the downward tongue the amount of material to be deformed to be able to insert the downward tongue into the upward groove can be kept to a minimum. Less deformation leads to less material stress which is in favour of the life span of the coupling part(s) and hence of the floor panel(s). In the coupled state of adjacent floor panels, the upper surface of the downward groove is preferably at least partially, and preferably substantially completely, supported by the upper surface of the upward tongue, which provides additionally strength to the coupling as such. To this end, it is advantageous that the inclination of the upper surface of the downward groove substantially corresponds to the inclination of the upper surface of the upward tongue. This means that the inclination of the upper surface of the downward groove is preferably situated between 15 and 45 degrees, more preferably between 25 and 35 degrees, and is most preferably about 30 degrees, with respect to a horizontal plane. As already mentioned, this inclination may be either flat or rounded, or eventually hooked.

The floor panel comprises a single upward tongue and a single downward tongue. The expression "single tongue" means that merely a clearly recognizable single-piece, non-segmented tongue is applied rather than multiple tongues and/or rather than a segmented (fork-like) tongue having tines or prongs (parallel or branching spikes) enclosing one or more accommodating spaces for dust and/or separate sealing elements. Each of the upward tongue and the downward tongue is preferably substantially rigid, which means that the tongues are not typically configured to be subjected to deformation. The tongues as such are preferably relatively stiff and hence practically non-flexible, also due to their relatively robust design. Moreover, the tongues are preferably substantially solid, which means that the tongues are substantially massive and thus completely filled with material and are therefore not provided with grooves at an upper surface which would weaken the construction of the tongue and hence of the floor panel connection to be realised. By applying a rigid, solid tongue a relatively firm and durable tongue is obtained by means of which a reliable and the durable floor panel connection can be realised without using separate, additional components to realise a durable connection. Just like the downward tongue being connected to the core by means of a bridge, as mentioned above, also the upward tongue is connected to the core by means of a(nother) bridge. Preferably, at least a part of the bridges, due to their limited thickness, are resilient to some extent to allow slight and commonly temporary deformation of the third and fourth edges during coupling of these edges. Preferably, the thickness of at least the bridge connecting the downward tongue to the core varies in a direction perpendicular to the fourth edge. More preferably, the thickness of at least the bridge connecting the downward tongue to the core decreases in a direction perpendicular to the fourth edge and toward the downward tongue. This, preferably continuous, decreasing thickness of the bridge has two advantages; a thicker part of the bridge provides the bridge sufficient robustness, while a thinner part of the bridge will become the weakest point and will therefore be able to deform most easily during coupling of the panels. Preferably, this deformation point (or pivoting point) is located close to the downward tongue. The core of the floor panel is preferably also substantially rigid, which means that the core is not configured to be subjected to deformation. By applying a rigid panel a relatively firm and durable panel can be obtained without using separate, additional components to realise a durable connection.

Preferably, at least a part of a side of the downward tongue facing away from the downward flank forms an inclined downward aligning edge for the purpose of coupling the fourth edge to a third edge of an adjacent panel. Also this inclined aligning edge, which may also be flat and/or rounded, also serves to facilitate a correct mutual positioning of the fourth and third edges, and therefore the ease of mutual coupling of both edges. Preferably the upward and/or downward aligning edge is substantially flat and forms a linear aligning surface. This surface can, in turn, be rounded off on the edges. A substantially flat and linear aligning edge facilitates a correct positioning of different floor panels upon coupling. In yet another embodiment the effective height of the inclined downward aligning edge is larger than the effective height of the upward tongue. This commonly results in the situation that the downward aligning edge of a floor panel does not engage another floor panel in case of a pre-aligned state (intermediate state). The position-selective contactless pre-alignment does prevent or counteract forcing the downward aligning edge of a floor panel along the upper surface of another floor panel, which could damage the floor panels.

In an embodiment of the floor panel, at least a part of the upward flank adjoining the upper side of the floor panel is adapted to make contact with at least a part of the downward tongue adjoining the upper side of another floor panel in a coupled state of these floor panels. Engagement of these surfaces will lead to an increase of the effective contact surface between the coupling elements and hence to an increase of stability and sturdiness of the connection between two floor panels. In a favourable embodiment the upper side of the floor panel is adapted to engage substantially seamless to the upper side of another floor panel, as a result of which a seamless connection between two floor panels, and in particular the upper surfaces thereof, can be realised.

In another embodiment the first locking element is positioned at a distance from an upper side of the upward tongue. This is favourable, since this will commonly result in the situation that the first locking element is positioned at a lower level than the upward aligning edge of the floor panel, which has the advantage that the maximum deformation of the fourth edge can be reduced, whereas the connection process and deformation process can be executed in successive steps. Less deformation leads to less material stress which is in favour of the life span of the coupling part(s) and hence of the floor panel(s). In this embodiment the second locking element is complementary positioned at a distance from an upper side of the downward groove. In an alternative embodiment, the first locking element is positioned at a distance from a lower side of the upward tongue, which may also facilitate coupling. The positioning of the complementary second locking element will be such that both locking element will co-act in the coupled state of the third and fourth edge. Preferably the first locking element is located on a substantially vertical part of the upward tongue, such that above and below the locking element the upward tongue has a substantially vertically orientated surface. This allows for a clear distinguishing between the locking element(s) and the tongue, and for a clean coupling of two floor panels. The substantially vertical surface above the first locking element allows a complementary counter profile to be aligned more easily into a relatively stable intermediate coupling position (see also FIG. 7*c*). Moreover, positioning the first locking element at a distance from the upper surface of the upward tongue reduces the maximum deformation the profiles have to be subjected to, which reduces the risk of breakage, and which improves the durability of the profiles and their connection. Additionally, positioning the first locking element at a distance from the upper surface of the upward tongue improves at least the rotational locking effect caused by the co-action between the first locking element and the second locking element.

In an embodiment the mutual angle enclosed by at least a part of a side of the upward tongue facing toward the upward flank and the normal of the upper side of the core is substantially equal to the mutual angle enclosed by at least a part of a side of the downward tongue facing toward the downward flank and the normal of the lower side of the core. A close-fitting connection of the two tongue parts to each other can hereby be realized, this generally enhancing the firmness of the coupling between the two floor panels. In an embodiment variant the angle enclosed by on the one hand the direction in which at least a part of a side of the upward tongue facing toward the upward flank extends and on the other the normal of the upper side of the core lies between 0 (or 1) and 60 degrees, in particular between 0 (or 1) and 45 degrees, more particularly between 0 (or 1) and 10 degrees. In a particular embodiment this angle lies between 0.5 and 5 degrees. In another embodiment variant the angle enclosed by on the one hand the direction in which at least a part of a side of the downward tongue facing toward the downward flank extends and on the other the normal of the lower side of the core lies between 0 and 60 degrees, in particular between 0 and 45 degrees, more particularly between 0 and 10 degrees. In a particular embodiment this angle lies between 0.5 and 5 degrees. The eventual inclination of the tongue side facing toward the flank usually also depends on the production means applied to manufacture the floor panel. In an embodiment inclination of the downward aligned edge is less than the inclination of at least an upper part of the upward flank, as result of which an expansion chamber will be formed between both surface which will be favourable to allow play and to compensate expansion, e.g. due to moist absorption by the floor panels.

In another embodiment variant at least a part of the aligning edge of the fourth edge has a substantially flatter orientation than at least a part of the upward flank of the third edge. By applying this measure there is generally created in a coupled position an air gap between the aligning edge of the fourth edge and a flank of the third edge. This clearance intentionally created between the two coupling parts is usually advantageous during coupling of adjacent floor panels, since this clearance does not prevent a temporary deformation of the coupling parts, this facilitating coupling of the coupling parts. Furthermore, the created clearance is advantageous for the purpose of absorbing expansion of the floor panel, for instance resulting from moisture absorption, this not being inconceivable when the floor panel is at least partially manufactured from wood. The created clearance may also act as dust chamber.

In an embodiment variant a part of the upward flank of the third edge connecting to the core forms a stop surface for at least a part of the side of the downward tongue facing away from the downward flank. In this way a close fitting of at least the upper side of the floor panels can be realized, this usually being advantageous from a user viewpoint. A part of the upward flank of the third edge connecting to the core is here preferably oriented substantially vertically. At least a part of the side of the downward tongue facing away from the downward flank is here also preferably oriented substantially vertically. Applying substantially vertical stop surfaces in both coupling parts has the advantage that in the coupled position the coupling parts can connect to each other in relatively close-fitting and firm manner.

It is generally advantageous for the upward groove to be adapted to receive with clamping fit a downward tongue of an adjacent panel. Receiving the upward groove, or at least a part thereof, with clamping fit in the downward tongue has the advantage that the downward tongue is enclosed relatively close-fittingly by the upward groove, this usually enhancing the firmness of the coupled construction. The same applies for the embodiment variant in which the downward groove is adapted to receive with clamping fit an upward tongue of an adjacent panel.

In an embodiment variant the upward flank and the downward flank extend in a substantially parallel direction. This makes it possible to connect the flanks, as well as the locking elements, relatively closely to each other in a coupled position, this generally enhancing the locking effect realized by the locking elements.

In another embodiment variant the first locking element comprises at least one outward bulge, and the second locking element comprises at least one recess, or vice versa, which outward bulge is adapted to be at least partially received in a recess of an adjacent coupled floor panel for the purpose of realizing a locked coupling. This embodiment variant is generally advantageous from a production engineering viewpoint. The first locking element and the second locking element preferably take a complementary form, whereby a form-fitting connection of the locking elements of adjacent floor panels to each other will be realized, this enhancing the effectiveness of the locking. The fact that the first locking element preferably comprises a bulge obviously also means that the first locking element could be formed by a bulge, and the fact that the second locking element preferably comprises a recess obviously also means that the second locking element could be formed by a recess.

The third edge and the fourth edge are preferably integrally connected to the core. The same applies to the first and second edges, which are preferably also integrally connected to the core. From a structural, production engineering and logistics viewpoint this integral connection between the core and the edges to form a single piece panel is generally recommended.

In an embodiment variant the panel is manufactured at least partially from wood. The floor panel can herein form a wooden plank and/or a parquet floor panel. The panel according to the invention is however also exceptionally suitable for application as laminated floor panel, wherein the floor panel comprises a laminate of a balancing layer (backing layer), a core layer comprising a wood and/or plastic product and at least one top structure arranged on an upper side of the carrier layer. The top structure commonly comprises a decorative layer on top of which a transparent protective layer is applied. The top structure commonly comprises a multiple layers having different properties. A wood or tile structure can further be pressed into the protective layer, whereby the top layer in fact also forms an embossed layer. The decorative layer is generally formed by a photo of wood or of tiles printed on paper usually saturated in melamine resin. It is also possible these days to print a decorative pattern directly onto the core layer by using dedicated printing devices. The core layer generally comprises a wood fibreboard, in particular an MDF board (Medium Density Fibreboard) or HDF board (High Density Fibreboard). It is also possible to envisage the floor panel being manufactured wholly from metal and/or textile instead of being manufactured from wood and/or plastic.

In a preferred embodiment variant the panel is manufactured at least partially from plastic, in particular thermoplastic, preferably polyvinylchloride (PVC). It is possible here to envisage the floor panel according to the invention being manufactured substantially wholly from plastic. Preferably, the core is made of a laminate of material layers, wherein a central layer is made of at least one thermoplastic material, wherein the core has a top surface and a bottom surface. Affixed to the top surface of the core is print layer, wherein the print has a top surface and a bottom surface. Also, an overlay layer can be affixed directly to the top surface of the core, or affixed to the top surface of the print layer. The panel can optionally contain an underlay layer located and affixed between the bottom surface of the print layer and the top surface of the core. In more detail, the core in the thermoplastic laminate panel preferably comprises at least one thermoplastic material, the at least one thermoplastic material being polyvinyl chloride. Generally, any combinations thereof, alloys thereof, or mixtures of two or more thermoplastics wherein at least one thermoplastic material is polyvinyl chloride can be used to form the core, or at least a central layer thereof. Generally, such thermoplastic materials include, but are not limited to, vinyl containing thermoplastics such as polyvinyl acetate, polyvinyl alcohol, and other vinyl and vinylidene resins and copolymers thereof; polyethylenes such as low density polyethylenes and high density polyethylenes and copolymers thereof; styrenes such as ABS, SAN, and polystyrenes and copolymers thereof; polypropylene and copolymers thereof; saturated and unsaturated polyesters; acrylics; polyamides such as nylon containing types; engineering plastics such as acetyl, polycarbonate, polyimide, polysufone, and polyphenylene oxide and sulphide resins and the like. One or more conductive polymers can be used to form the plank, which has applications in conductive flooring and the like. More preferably, the thermoplastic material is a rigid polyvinyl chloride but semi-rigid or flexible polyvinyl chloride may also be used. The flexibility of the thermoplastic material can be imparted by using at least one liquid or solid plasticizer which is preferably present in an amount of less than about 20 phr (parts per hundred parts of resin), and more preferably, less than 1 phr. A typical rigid PVC compound used in the present invention to form the core can also include, but is not limited to, pigments, impact modifiers, stabilizers, processing aids, lubricants, fillers, wood flours, other conventional additives, and the like.

The invention also relates to a covering, in particular a floor covering, consisting of mutually coupled panels consisting of mutually coupled floor panels according to the invention.

The invention further relates to a method of assembling interconnectable panels, in particular panels according to the invention, for forming a covering, comprising the steps of:

providing a first panel, inserting a sideward tongue of a first edge of a second panel in an inclined position into a recess of a second edge of the first panel, angling down the second panel with respect to the first panel, until both panels are situated in the same plane, inserting a sideward tongue of a first edge of a third panel in an inclined position into a recess of a second edge of the first panel, and angling down the third panel with respect to the first and second panels, until the panels are situated in the same plane, wherein a downward tongue of a fourth edge of the third panel will zip into an upward groove of a third edge of the second panel, and wherein an upward tongue of the third edge of the second panel will snap into a downward groove of the fourth edge of the third panel, leading to locking of third panel with respect to the first panel at the first and second edges and with respect to the second panel at the third and fourth edges in both horizontal direction and vertical direction.

Advantages and further aspects of the method according to the invention have been described above already in a comprehensive manner.

It will be apparent that the invention is not limited to the exemplary embodiments shown and described here, but that within the scope of the appended claims numerous variants are possible which will be self-evident to the skilled person in this field.

BRIEF DESCRIPTION OF THE DRAWINGS

The invention will be elucidated on the basis of non-limitative exemplary embodiments shown in the following figures. Herein.

DESCRIPTION OF THE INVENTION

Figure 1:
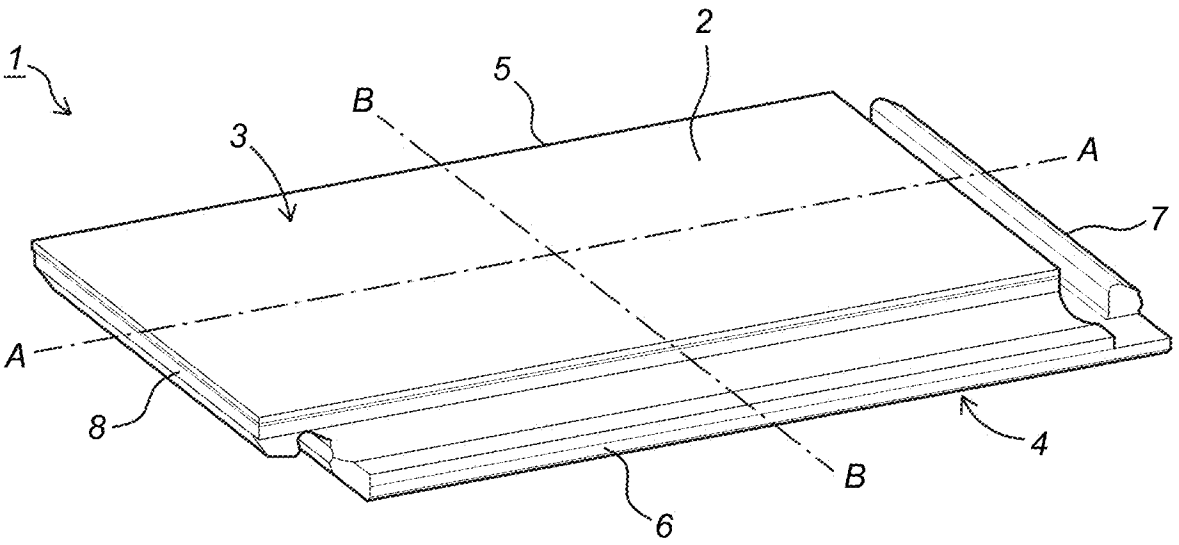
FIG. 1 shows a rectangular floor panel according to the present invention.

FIG. 1 shows a rectangular floor panel 1 according to the present invention. The panel 1 is interconnectable with similar panels for forming a covering, as will be shown in further figures. The floor panel 1 can be made of any material, though typical materials are wood, in particular HDF, MDF, and LDF, and plastic, in particular thermoplastic, more in particular PVC. Commonly, the floor panel 1 is made of a laminate comprising a central layer (core layer) enclosed by a backing structure and a top structure (not shown). The top structure commonly comprises a decorative layer, which may be printed onto the central layer, on top of which a protective layer is applied. The panel 1 comprises a centrally located core 2 provided with an upper side 3 and a lower side 4. The core 2 is integrally connected with a first pair of opposite edges, in particular a first edge 5 and a complementary second edge 6, located at the long lateral sides of the panel 1. The core is also integrally connected with a second pair of opposite edges, in particular a third edge 7 and a complementary fourth edge 8, located a the short sides of the panel 1 in this exemplary embodiment.

Figure 2:
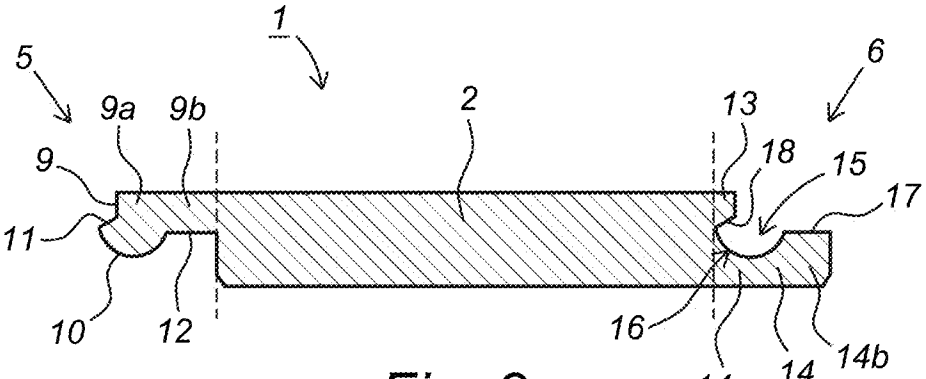
FIG. 2 is a cross-sectional view indicated by section A-A in FIG. 1.

FIG. 2 is a cross-sectional view indicated by section A-A in FIG. 1. In this cross-section, the shape of the complementary first edge 5 and second 6 edge are shown in detail. The first edge 5 comprises a sideward tongue 9 which is integrally connected to the core 2. By means of the vertical dashed line the border between the sideward tongue 9 and the core 2 is visualized. A front region 9*a* of the sideward tongue 9 is provided with a rounded bottom surface 10. An outer end of the rounded bottom surface 10 adjoins an inclined locking surface 11. An opposite end of the rounded bottom surface 10 adjoins a bearing surface 12 making part of a back region 9*b* of the sideward tongue 9. The second edge 6 of the panel 1 comprises an upper lip 13 and a lower lip 14 defining a recess 15. Both lips 13, 14 are integrally connected to the core 2. By means of the vertical dashed line the border between the lips 13, 14 and the core is visualized. As shown in FIG. 2, the width of the upper lip 13 is substantially smaller than the width of the lower lip 14. The recess 15 has a shape which is complementary to the shape of the sideward tongue 9. More in particular, a top surface 16 of a back region 14*a* of the lower lip 14 has a (complementary) rounded shape, configured to co-act with the rounded front region 9*a* of the sideward tongue 9, while a front region 14*b* of the lower lip 14 is provided with a upwardly protruding shoulder 17, configured to co-act with the bearing surface 12 of the sideward tongue 9. A lower surface 18 of the upper lip 13 is inclined and corresponds to the locking surface 11 of the sideward tongue 9. Locking at the first edge 5 and the second edge 6 of adjacent panels 1 by insertion of the sideward tongue 9 of a panel 1 to be coupled into the recess 15, wherein said panel 1 is initially held in an inclined position. After insertion of the sideward tongue 9 into the recess, the panel 1 to be coupled will be pivoted (angled) in downward direction about an axis parallel to the first edge 5 until both panels 1 are positioned in the same—commonly horizontal—plane, wherein the locking surface 11 of the sideward tongue 9 will engage the locking surface of the upper lip 18, and wherein at least a bottom front part is accommodated substantially form-fittingly in the recess 15, and wherein the bearing surface 12 is supported by the shoulder 17. Locking at the first edge 5 and the second edge 6 leads to locking of the connected panels 1 in both horizontal direction and vertical direction. The angling down locking principle of the first and second edges 5, 6 is a relatively easy locking principle which facilitates mutual coupling of panels at these edges 5, 6 tremendously. Further details relating to this locking mechanism are visualised in FIGS. 4 and 5.

Figure 3:
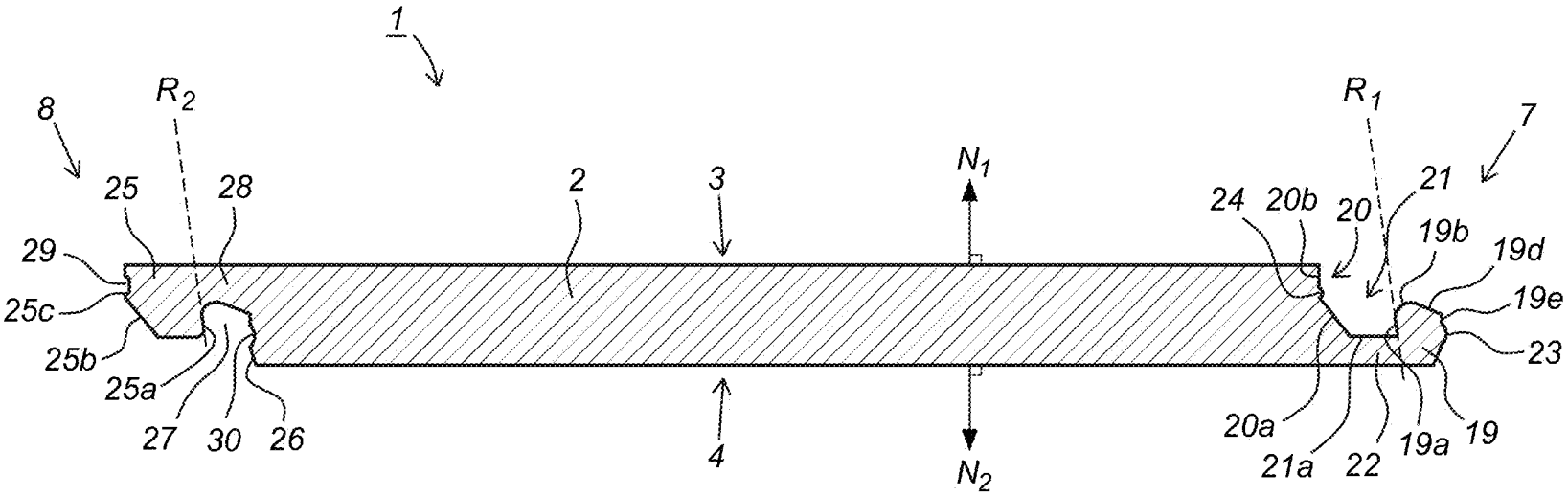
FIG. 3 is a cross-sectional view indicated by section B-B in FIG. 1.

FIG. 3 is a cross-sectional view indicated by section B-B in FIG. 1. In this cross-section, the shape of the complementary third edge 7 and second 8 edge are shown in detail. The third edge 7 comprises an upward tongue 19, an upward flank 20 and an upward groove 21 formed between upward tongue 19 and upward flank 20. The upward tongue 19 is connected to the core 2 by means of a bridge 22, which is preferably resilient to some extent. A side 19*a* of upward tongue 19 facing toward upward flank 20 extends in the direction of the normal $N_1$ of the upper side 3 of the core 2. The tangent $R_1$ and the normal $N_1$ of the upper side 3 of the core 2 are thus directed toward each other (converging orientation), wherein the angle enclosed by $R_1$ and $N_1$ is preferably between 0 and 10 degrees in this exemplary embodiment. Due to the converging orientation of the upward flank 20 and the side 19*a* of the upward tongue 19 facing toward to the upward flank 20, the upward groove 22 is a closed groove, which is only accessible to a complementary counterpart by deformation of the upward tongue 19 and/or bridge 22. Another side 19*b* of upward tongue 19 facing toward upward flank 20 forms an aligning edge enabling facilitated realization of a coupling to an adjacent floor panel 1. As shown, this side 19*b* functioning as aligning edge is directed away from the normal $N_1$ of upper side 3 of the core 2. An upper side 19*d* of upward tongue 19 does however extend in the direction of the normal $N_1$ of the upper side 3 of the core 2, and runs inclining downward in the direction of the side 19*e* of upward tongue 19 facing away from upward flank 20. This chamfering provides the option of giving the complementary fourth edge 8 a more robust and therefore stronger form. A part of the side 19*e* of upward tongue 19 facing away from upward flank 20 is oriented substantially vertically and is moreover provided with an outward bulge 23. A lower part 20*a* of upward flank 20 is oriented diagonally, while an upper part 20*b* of upward flank 20 is shown to be substantially vertical and forms a stop surface for fourth edge 8. In between the inclined part 20*a* and the substantially vertical part 20*b* of the upward flank an additional coupling element, in particular an additional bulge 24, is provided. A lower wall part 21*a* of upward groove 21 is oriented substantially horizontally in this exemplary embodiment.

The fourth edge 8 is substantially complementary to third edge 7. The fourth edge 8 comprises a downward tongue 25, a downward flank 26 and a downward groove 27 formed between downward tongue 25 and downward flank 26. The downward tongue 25 is connected to the core 2 by means of a bridge 28, which is preferably resilient to some extent. A side 25*a* of downward tongue 25 facing toward downward flank 26 lies in the direction of the normal $N_2$ of the lower side 4 of the core 2. This means that a tangent $R_2$ of side 25*a* of downward tongue 25 and the normal of the lower side 4 of the core 2 are mutually converging, wherein the angle enclosed by $R_2$ and $N_2$ is preferably between 0 and 10 degrees in this exemplary embodiment. More preferably, the inclination of $R_1$ is identical to the inclination of $R_2$; hence, $R_1$ and $R_2$ are preferably parallel. Due to the converging orientation of the downward flank 26 and the side 25*a* of the downward tongue 25 facing toward to the downward flank 26, the downward groove 27 is a closed groove, which is only accessible for the upward tongue 19 of an adjacent panel 1 by deformation of the downward tongue 25 and/or bridge 28, as a result of which the entrance of the downward groove can be widened (temporary).

A side 25*b* of the downward tongue 25 facing away from downward flank 26 is diagonally oriented, but has a flatter orientation than the complementary side 20*a* of upward flank 20, whereby a gap (air space) will be formed in the coupled position, which will generally facilitate coupling between two floor panels 1. The inclining side 25*b* of downward tongue 25 also functions as aligning edge for the purpose of further facilitating coupling between two floor panels 1. Another side 25*c* facing away from downward flank 26 takes a substantially vertical form, though is provided with a small cavity 29 configured to co-act with the additional bulge 24 of another panel 1. A top part of the side 25*c* facing away from downward flank 26 forms a complementary stop surface for stop surface 20*b* of upward flank 20 (of an adjacent floor panel). Downward flank 26 is oriented substantially vertically and is provided with a recess 30 adapted to receive the outward bulge 23 of the upward tongue 19 (of an adjacent floor panel).

Figure 4A:
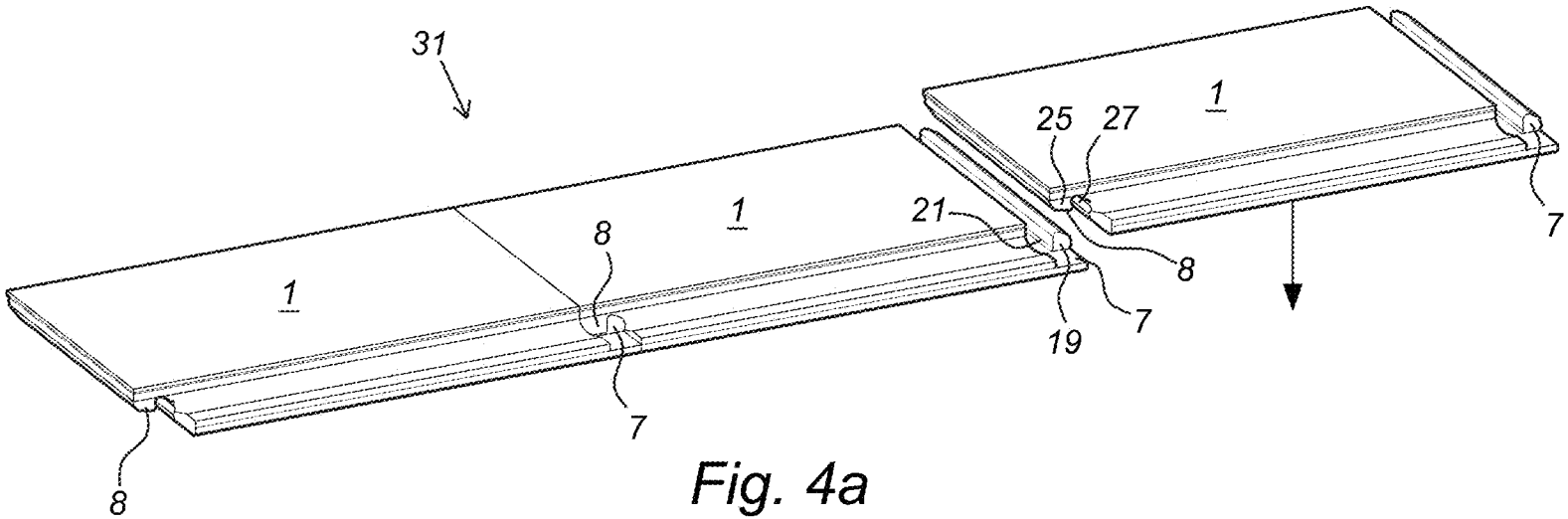
FIGS. 4*a*-4*f* show different views of the successive steps for interconnecting multiple floor panels according to FIGS. 1-3 for forming a floor covering.
Figure 4B:
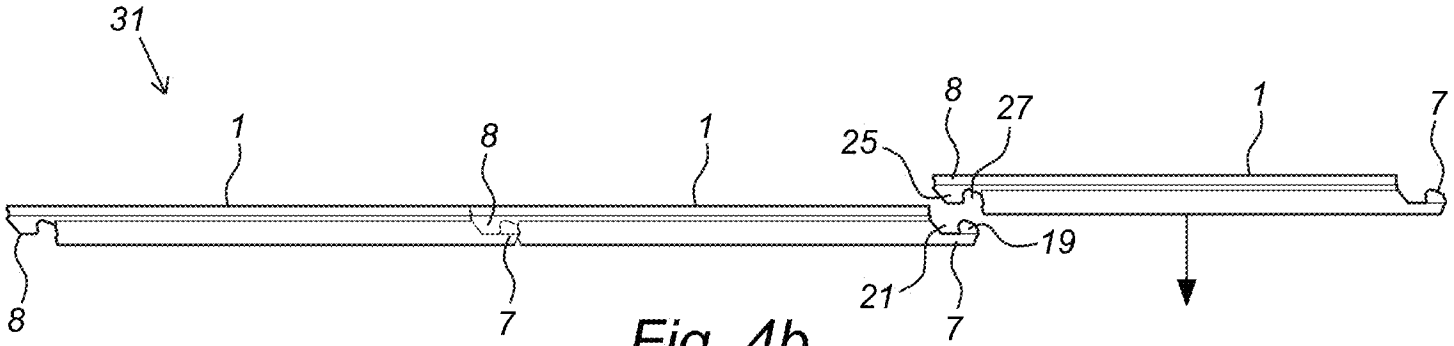

FIGS. 4*a*-4*f* show different views of the successive steps for interconnecting multiple floor panels 1 according to FIGS. 1-3 for forming a floor covering 31. FIGS. 4*a* and 4*b* relate to the first step of the installation process, wherein a first row of floor panels 1 is generated by connecting the third edge 7 of a panel 1 to the fourth edge 8 of an adjacent panel, by pressing—in a substantially vertical direction (as indicated by the arrow)—the fourth edge 8 of a panel 1 to be coupled onto and into the third edge 7 of an already installed panel 1. Due to the vertical displacement, the third edge 7 and/or the fourth edge 8 will be deformed slightly, such that the downward tongue 25 will be pushed into the upward groove 21, and the upward tongue 19 will be pushed into the downward groove 27. Moreover, the bulges 23, 24 will be positioned in the corresponding recesses 29, 30 to better secure the floor panels 1 with respect to each other. Due to this temporary deformation, wherein both the upward groove 21 and the downward grove 27 will be widened temporary for the insertion of the downward tongue 25 and the upward tongue 19 respectively, both edges 7, 8 will snap into each other.

Figure 4C:
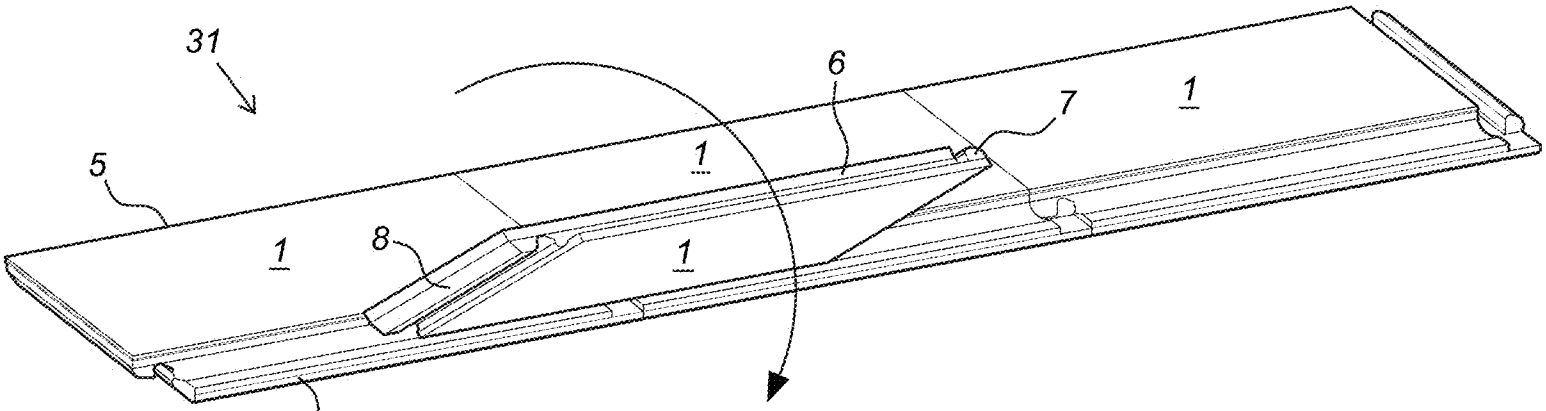
Figure 4D:
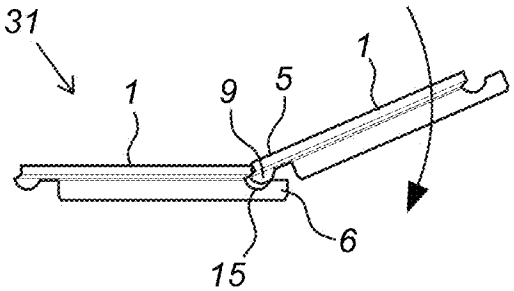
Figure 4E:
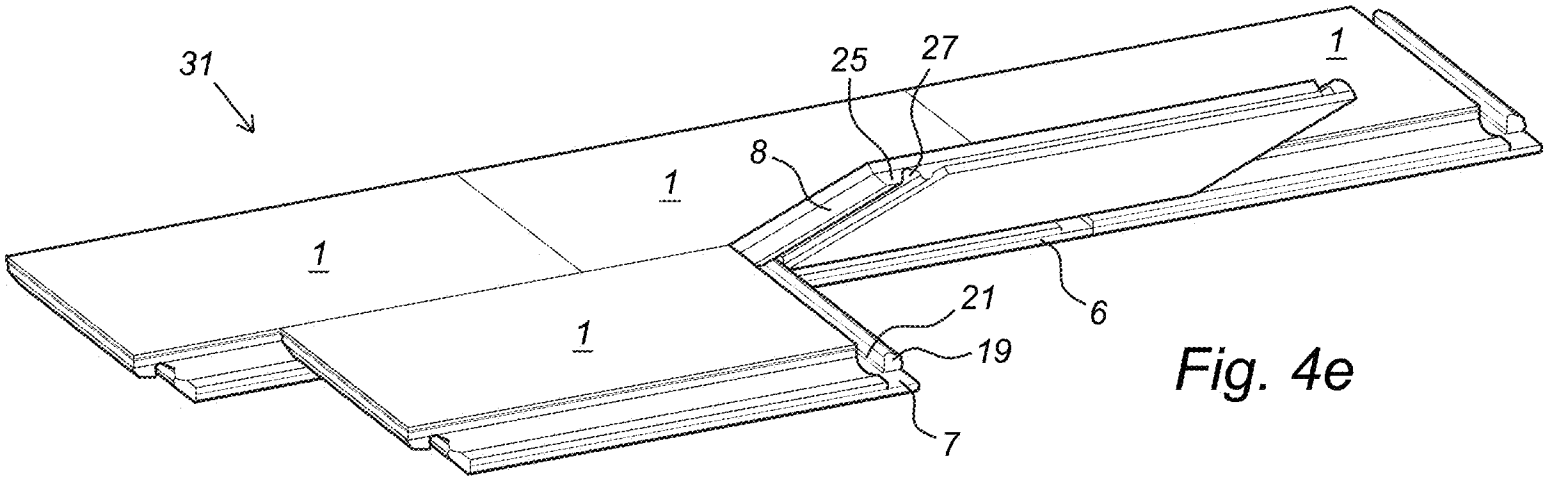
Figure 4F:
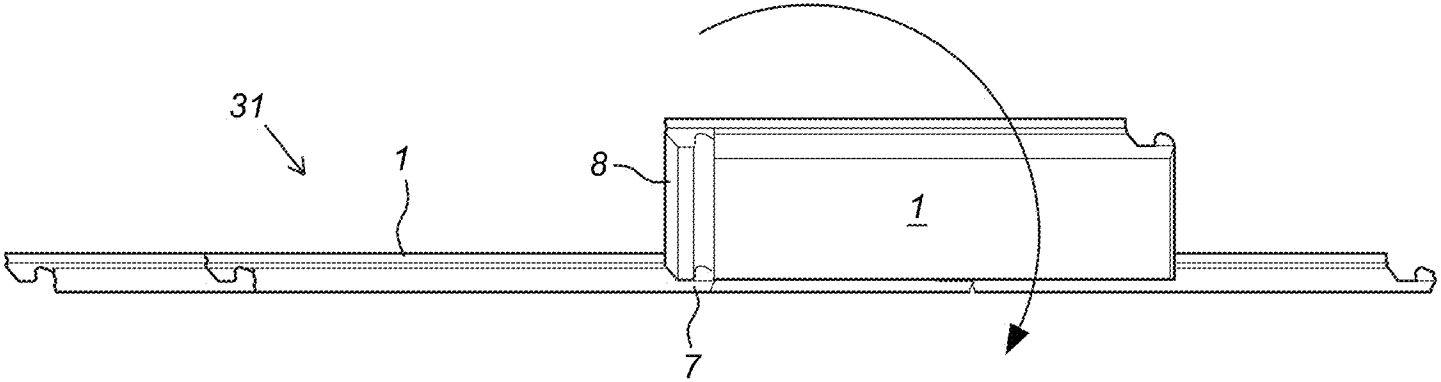

FIGS. 4*c* and 4*d* relate to the second step of the installation process, wherein a second row of floor panels 1 is created which is connected to the first row of floor panels. To this end, a first edge 5 of a floor panel 1 to be coupled is positioned in an inclined orientation against a second edge 6 of an already installed panel 1, such that the sideward tongue 9 is at least partially inserted in the complementary recess 15 of the second profile 6. After this partial insertion the inclined panel is pivoted (angled) down-see arrow-around an axis parallel to the first edge 5, until the panel 1 is located in the same plane as defined by the first row of panels, as a result of which the sideward tongue 9 will be locked into the recess 15 both in at least one horizontal direction and in vertical direction.

The first two steps as shown in FIGS. 4*a*-4*d* are preparatory steps for installation of one or more subsequent panels 1 which are to be coupled at multiple edges instead of only at a single edge. Installation of a subsequent floor panel 1 is visualized in FIGS. 4*e* and 4*f*. Again, a floor panel 1 to be coupled is held at inclined position, wherein the sideward tongue 9 of the floor panel 1 is inserted partially into the corresponding recess 15 of a second edge of at least one floor panel already installed. The fourth edge 8 of the floor panel 1 to be installed is positioned substantially above the third edge 7 of the panel 1 already installed in the second row, wherein the fourth edge 8 and the third edge 7 mutually enclose an angle (being the inclination angle of the panel to be coupled). During angling down of the panel 1 to be coupled (see arrow) both the first edge 5 and the fourth edge 8 of the panel 1 will be connected to adjacent panels 1. More in particular, during angling down of the panel 1, the front region of the sideward tongue 9 will be accommodated in the recess 15, and will be held in position by means of the limiting shoulder 17 and the limiting locking surface 18 of the upper lip 13 of the second edge 6 of the panel(s) already installed in the first row. Moreover, simultaneously the fourth edge 8 of the panel 1 to be coupled will make a downward scissoring movement with respect to the underlying third edge 7 and will zip (snap) into the third edge 7 and vice versa, leading to a firm and durable connection between the panels 1.

Figure 5A:
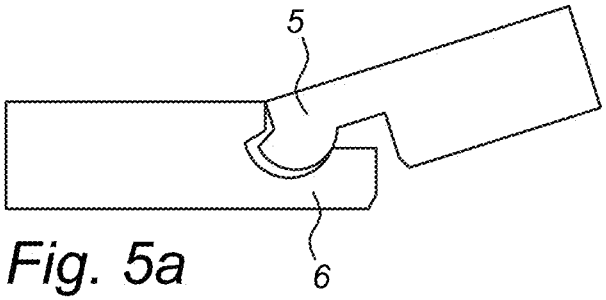
FIGS. 5*a*-5*e* show different embodiments of the first and second edges of a floor panel according to the invention.
Figure 5B:
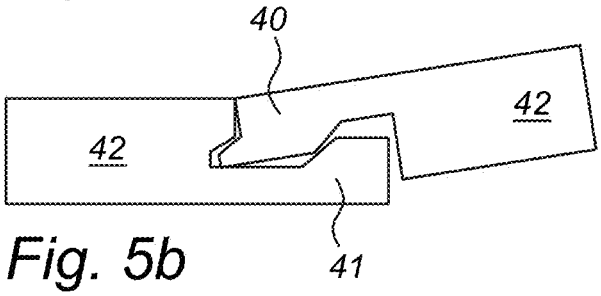
Figure 5C:
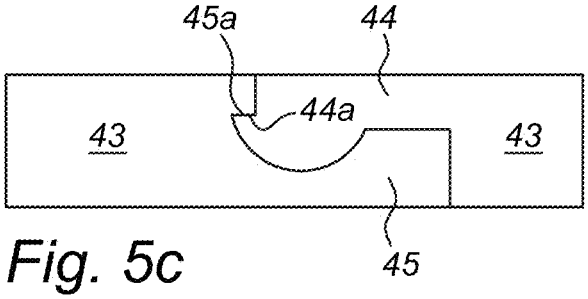
Figure 5D:
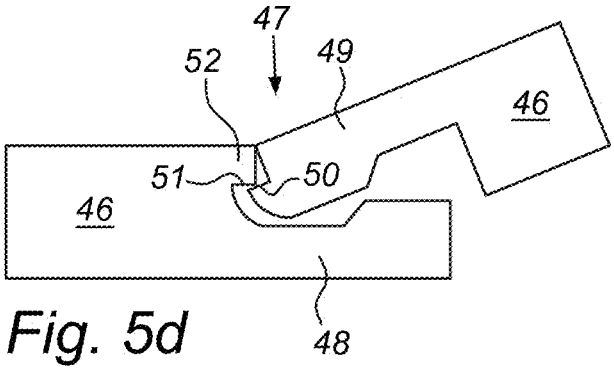
Figure 5E:
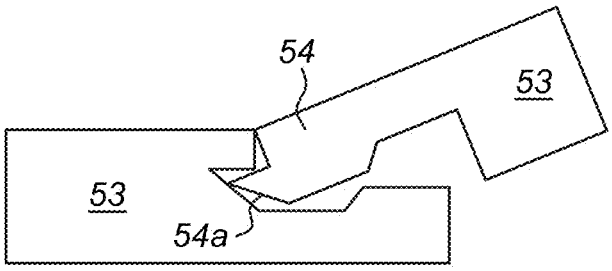

FIGS. 5*a*-5*e* show different embodiments of the first and second edges of a floor panel according to the invention. In FIG. 5*a* the embodiment according to FIGS. 1-4*f* is shown, while in FIGS. 5*b*-5*e* alternative embodiments of these edges are shown. More in particular, FIG. 5*b* shows a first and second edge 40, 41 of a floor panel 42, wherein, instead of a smoothly rounded bottom portion a more hooked (segmented rounded) bottom portion is shown. In FIG. 5*c*, an embodiment of a floor panel 43 is shown which is almost identical to the floor panel shown in FIG. 5*a*, though wherein the first and second edges 44, 45 are provided with horizontal locking surfaces 44*a*, 45*b* instead of inclined locking surfaces. In FIG. 5*d*, an alternative embodiment of a floor panel 46 is shown, wherein the first and second edges 47, 48 are shaped such that a bottom contact portion between the two edges 47, 48 is partially smoothly rounded and partially discontinuously rounded (segmented rounded). Locking surfaces 50, 51 of a sideward tongue 49 of the first edge 47 and of an upper lip 52 of the second edge have a substantially horizontal orientation. In FIG. 5*e*, an embodiment of a floor panel 53 almost identical to the floor panel 46 as shown in FIG. 5*d* is shown, with the difference that a front bottom part 54*a* of a sideward tongue 54 is not smoothly rounded, but flat giving a bottom portion of the sideward tongue 54 as such a segmented rounded (hooked) shape.

Figure 6:
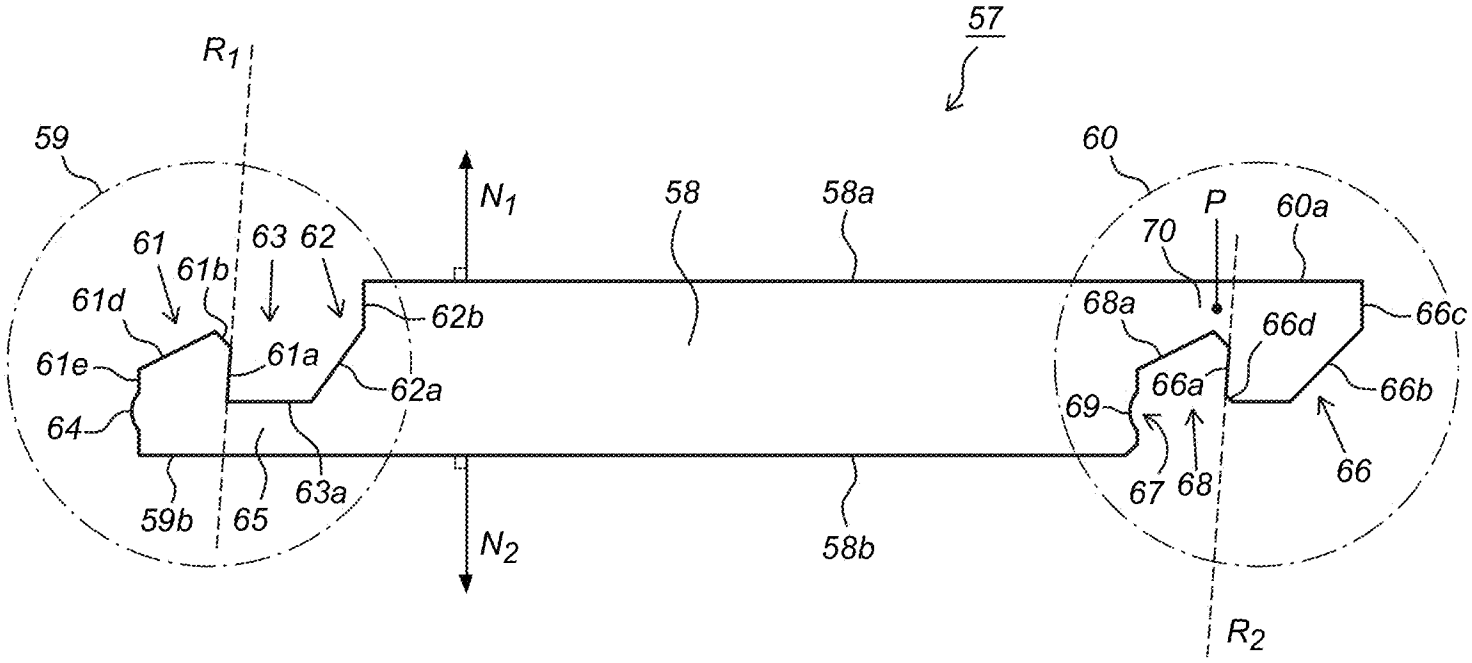
FIG. 6 shows a different embodiment of the third and fourth edges of a floor panel according to the invention.

FIG. 6 shows a different embodiment of the third and fourth edges of a floor panel 57 according to the invention. Floor panel 57 comprises a core 58 provided with an upper side 58*a* and a lower side 58*b*, and coupling parts 59, 60 positioned on opposite longitudinal sides of core 58 and connected integrally to core 58. A first coupling part 59 comprises an upward tongue 61, an upward flank 62 and an upward groove 63 formed between upward tongue 61 and upward flank 62. A side 61*a* of upward tongue 61 facing toward upward flank 62 is inclined and extends in the direction of the normal N1 of the upper side 58*a* of core 58. The tangent R1 and the normal $N_1$ of upper side 58*a* of core 58 are thus directed toward each other (converging orientation), wherein the angle enclosed by R1 and N1 amounts to 3-5 degrees. On top of side 61*a*, a substantially flat upward aligning edge 61*b* of the upward tongue 61 is positioned, which faces toward upward flank 62 and which enables facilitated realization of a coupling to an adjacent floor panel. The inclined surface 61*a*, acting as locking surface, and the adjoining upward aligning edge 61*b* together form the inner side surface of the upward tongue 61. As shown, this side 61*b* functioning as upward aligning edge is substantially flat and, moreover, directed away from the normal N1 of upper side 58*a* of the core. A (single) upper side 61*d* of upward tongue 61 does however extend in the direction of the normal N1 of upper side 68*a* of core 68, and runs inclining downward in the direction of the side 61*e* of upward tongue 61 facing away from upward flank 62. The angle of inclination is about 30 degrees. This chamfering provides the option of giving the complementary second coupling part 60 a more robust and therefore stronger form, as will be elucidated below. The side 61*e* of upward tongue 61 facing away from upward flank 62 is oriented substantially vertically and is moreover provided with an outward bulge 64 which clearly extends with respect to vertically oriented parts of the outer side wall 61 of the upward tongue 59. A lower part 62*a* of upward flank 62 is oriented diagonally, while an upper part 62*b* of upward flank 62 is shown to be substantially vertical and forms a stop surface for second coupling part 60. A lower wall part 63*a* of upward groove 43 is oriented substantially horizontally in this exemplary embodiment. A bridge 65 lying between lower wall part 63*a* of upward groove 63 and a lower side 59*a* has a somewhat elastic nature and is adapted to allow upward tongue 61 to slightly pivot relative to upward flank 62, this resulting in a (temporary) widening of upward groove 63, whereby coupling of floor panel 57 to an adjacent floor panel can be facilitated. Second coupling part 60 is substantially complementary to first coupling part 59. Second coupling part 60 comprises a downward tongue 66, a downward flank 67 and a downward groove 68 formed between downward tongue 66 and downward flank 67. A side 66*a* of downward tongue 66 facing toward downward flank 67 is inclined and extends in the direction of the normal N2 of the lower side 58*b* of core 58. This means that a tangent R2 of side 66*a* of downward tongue 66 and the normal of the lower side 58*b* of core 58 are mutually converging. In this exemplary embodiment the tangent R2 and the normal N2 enclose a mutual angle of 3-5 degrees. A side 66*b* facing away from downward flank 67 is diagonally oriented, but has a flatter orientation than the complementary side 62*a* of upward flank 62, whereby a gap (air space) will be formed in the coupled position, which will generally facilitate coupling between two floor panels 57. The inclining side 66*b* of downward tongue 66 also functions as aligning edge for the purpose of further facilitating coupling between two floor panels 57. Another side 66*c* facing away from downward flank 67 takes a substantially vertical form and forms a complementary stop surface for stop surface 62*b* of upward flank 62 (of an adjacent floor panel). Downward tongue 66 is further provided with a small aligning edge 66*d* which is facing toward downward flank 67. Because upper side 61*d* of upward tongue 61 has an inclining orientation, an upper side 68*a* of downward groove 68 likewise can be given, and in this embodiment has, a corresponding inclining orientation, whereby the (average) distance between upper side 68*a* of downward groove 68 and an upper side 60*a* of second coupling part 60 is sufficiently large to impart sufficient strength to second coupling part 60 as such. Downward flank 67 is oriented substantially vertically and is provided with a recess 69 adapted to receive the outward bulge 64 of upward tongue 61 (of an adjacent floor panel).

A bridge 70 lying between upper side 68*a* of downward groove 68 and upper side 60*a* has a somewhat elastic nature due its reduced thickness close to the downward tongue 66 (and possibly also due to material characteristics), and is adapted to allow downward tongue 66 to slightly pivot relative to downward flank 67, this resulting in a (temporary) widening of downward groove 68, whereby coupling of floor panel 67 to an adjacent floor panel can be facilitated. This pivoting point (point of deformation) is typically formed by the weakest point in the bridge 70, which is indicated by the sign "P". The shown floor panel 67 can form a parquet floor panel, a plank, a laminated floor panel and/or a plastic floor panel. The coupling parts 59, 60 and the core 58 are preferably integrally connected.

This summary is meant to provide an introduction to the concepts that are disclosed within the specification without being an exhaustive list of the many teachings and variations upon those teachings that are provided in the extended discussion within this disclosure. Thus, the contents of this summary should not be used to limit the scope of the claims that follow.

Inventive concepts are illustrated in a series of examples, some examples showing more than one inventive concept. Individual inventive concepts can be implemented without implementing all details provided in a particular example. It is not necessary to provide examples of every possible combination of the inventive concepts provide below as one of skill in the art will recognize that inventive concepts illustrated in various examples can be combined together in order to address a specific application.

Other panel constructions, assembling methods, features and advantages of the disclosed teachings will be or will become apparent to one with skill in the art upon examination of the following figures and detailed description. It is intended that all such additional panel constructions, assembling methods, features and advantages be included within the scope of and be protected by the accompanying claims.

The invention claimed is:

1. A panel interconnectable with similar panels for forming a covering, comprising:

a core provided with an upper side and a lower side, said core being provided with:

a first pair of opposite edges, comprising:

a first edge comprising a sideward tongue extending in a direction substantially parallel to the upper side of the panel, a bottom back region located closer to the level of the upper side of the panel than an at least partially planar and/or rounded lowest part of a bottom front region, an opposite, second edge comprising a recess for accommodating at least a part of the sideward tongue of a second panel, said recess being defined by an upper lip and a lower lip, said lower lip being provided with an upwardly protruding shoulder facing a bearing region of the sideward tongue of an adjacent panel in coupled condition of adjacent panels, the sideward tongue being designed such that locking takes place by an introduction movement into the recess of a sideward tongue of the second panel and an angling down movement about an axis parallel to the first edge of the second panel and the second edge of the first panel, as a result of which a top side of the sideward tongue will engage the upper lip and the bearing region of the sideward tongue will be supported by and/or facing the shoulder of the lower lip, leading to locking of the panel and the second panel at the first edge of the second panel and second edge of the first panel in both a horizontal direction and a vertical direction; and a second pair of opposite edges, comprising:

a third edge comprising a single upward tongue, at least one upward flank lying at a distance from the upward tongue and a single upward groove formed between the upward tongue and the upward flank, and a fourth edge comprising a single downward tongue, at least one downward flank lying at a distance from the downward tongue, and a single downward groove formed between the downward tongue and the downward flank, wherein a side of the downward tongue facing away from the downward flank is provided with a locking element at least partially formed by a bulge, and wherein the upward flank is provided with a counter-locking element at least partially formed by a cavity, said locking element being adapted to cooperate with said counter-locking element of another panel, wherein a level of a highest part of the upward tongue differs from a level of said locking element and said counter-locking element, the third and fourth edges being designed such that locking takes place during angling down of the second panel at a first edge to a second edge of the panel, wherein the fourth edge of the second panel makes a scissoring movement toward the third edge of the third panel, such that the downward tongue of the fourth edge of the second panel will be forced into the upward groove of the third edge of the third panel and the upward tongue of the third panel will be forced into the downward groove of the second panel, by resilient deformation of the third edge, leading to locking of adjacent panels at the third and fourth edges in both the horizontal direction and the vertical direction, wherein at least a part of a side of the upward tongue facing toward the upward flank is inclined with respect to the normal of the upper side of the core, wherein at least a part of a side of the downward tongue facing toward the downward flank is inclined with respect to the normal of the lower side of the core, and wherein, in coupled condition of adjacent panels a distance is present between the upward tongue of said panel and the downward flank of an adjacent panel.

2. The panel according to claim 1, wherein a side of the shoulder facing the core has an inclined orientation for forcing two panels, in an assembled state, toward each other.

3. The panel according to claim 1, wherein the panel has a substantially rectangular shape, wherein the first pair of opposite edges are located on the long sides of the panel, and the second pair of opposite edges are located on the short sides of the panel.

4. The panel according to claim 1, wherein at least a part of a side of the upward tongue facing toward the upward flank forms an upward aligning edge for the purpose of coupling the third edge to a fourth edge of an adjacent panel and/or wherein at least a part of a side of the downward tongue facing away from the downward flank forms an inclined downward aligning edge for the purpose of coupling the fourth edge to a third edge of an adjacent panel.

5. The panel according to claim 1, wherein each of the upward tongue and the downward tongue is substantially rigid and/or substantially solid.

6. The panel according to claim 1, wherein at least a part of the upward flank adjoining the upper side of the panel is adapted to make contact with at least a part of the downward tongue adjoining the upper side of another panel in an assembled state.

7. The panel according to claim 1, wherein the upper side of the panel is adapted to engage substantially seamless to the upper side of another panel.

8. The panel according to claim 1, wherein only a part of a side of the downward tongue facing toward the downward flank is inclined away from the downward flank and extends in a direction away from the normal of the lower side of the core.

9. The panel according to claim 1, wherein at least a part of an upper side of the upward tongue runs inclining downward in the direction of the side of the upward tongue facing away from upward flank, and wherein at least a part of an upper side of the downward groove having an inclining orientation upward in the direction of the side of the downward tongue facing towards the downward flank.

10. The panel according to claim 1, wherein at least a part of the aligning edge of the fourth edge has a substantially flatter orientation than at least a part of the upward flank of the third edge.

11. The panel according to claim 1, wherein a part of the upward flank of the third edge connecting to the core forms a stop surface for at least a part of the side of the downward tongue facing away from the downward flank.

12. The panel according to claim 1, wherein a part of the upward flank of the third edge connecting to the core is oriented substantially vertically and/or wherein at least a part of the side of the downward tongue facing away from the downward flank is oriented substantially vertically.

13. The panel according to claim 1, wherein the upward groove is given a form such that this upward groove is adapted for receiving in locked manner at least a part of a downward tongue of an adjacent panel wherein the upward groove is adapted to receive with clamping fit a downward tongue of an adjacent panel and wherein the downward groove is adapted to receive with clamping fit an upward tongue of an adjacent panel.

14. The panel according to claim 1, wherein at least a part of a side of the upward tongue facing away from the upward flank comprises a substantially rigid first locking element, and wherein the downward flank comprises a substantially rigid, second locking element adapted for co-action with a first rigid locking element of a third edge of a third panel.

15. The panel according to claim 14, wherein the first locking element is positioned at a distance from an upper side of the upward tongue and/or wherein the first locking element is positioned at a distance from a lower side of the upward tongue.

16. The panel according to claim 14, wherein the second locking element is positioned at a distance from an upper side of the downward groove and/or wherein the second locking element is positioned at a distance from a lower side of the downward groove.

17. The panel according to claim 14, wherein the first locking element comprises at least one outward bulge, and that the second locking element comprises at least one recess, which outward bulge is adapted to be at least partially received in a recess of an adjacent coupled panel for the purpose of realizing a locked coupling.

18. The panel according to claim 14, wherein a part of a side of the upward tongue facing toward the upward flank forms an upward aligning edge for the purpose of coupling the third edge to a fourth edge of the second panel, wherein the first locking element is positioned at a lower level than the upward aligning edge.

19. The panel according to claim 1, wherein at least a part of a side of the upward tongue facing toward the upward flank is inclined away from the upward flank and extends in a direction away from the normal of the upper side of the core, and wherein at least a part of a side of the downward tongue facing toward the downward flank is inclined away from the downward flank and extends in a direction away from the normal of the lower side of the core.

20. The panel according to claim 1, wherein the panel is manufactured at least partially from wood and/or from plastic.

21. The panel according to claim 1, wherein at least a part of an upper side of the upward tongue is planar, and wherein at least a part of an upper side of the downward groove is planar.

22. The panel according to claim 1, wherein at least a part of an upper side of the upward tongue is curved, and wherein at least a part of an upper side of the downward groove is curved.

23. The panel according to claim 1, wherein a top structure is arranged on top of the core wherein the top structure comprises a decorative layer and a protective layer arranged on top of said decorative layer.

24. The panel according to claim 1, wherein at least a part of the lower wall part of the upward groove and at least a part of a lower side of the downward tongue are planar.

25. The panel according to claim 1, wherein, in coupled condition of adjacent panels, the third edge and the fourth edge do not exert a force onto each other and are free of pretension.

26. The panel according to claim 1, wherein, in coupled condition of adjacent panels, a pretension is present between the third edge and the fourth edge.

* * * * *